US009319777B2

(12) United States Patent
Aoki et al.

(10) Patent No.: US 9,319,777 B2
(45) Date of Patent: Apr. 19, 2016

(54) DRIVE CONTROL CIRCUIT FOR VIBRATION SPEAKER

(75) Inventors: Daisuke Aoki, Aichi-ken (JP); Tsutomu Murata, Mizuho (JP)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 785 days.

(21) Appl. No.: 13/228,156

(22) Filed: Sep. 8, 2011

(65) Prior Publication Data

US 2012/0063632 A1 Mar. 15, 2012

(30) Foreign Application Priority Data

Sep. 10, 2010 (JP) ..... 2010-203111

(51) Int. Cl.

| | |
|---|---|
| ***H04R 3/00*** | (2006.01) |
| ***H04R 29/00*** | (2006.01) |
| ***H04R 9/02*** | (2006.01) |
| ***H04R 9/10*** | (2006.01) |

(52) U.S. Cl.

CPC ..... *H04R 3/00* (2013.01); *H04R 9/025* (2013.01); *H04R 9/10* (2013.01); *H04R 2400/01* (2013.01)

(58) Field of Classification Search

CPC ..... H04R 3/00; H04R 3/04; H04R 9/02; H04R 9/025; H04R 9/046; H04R 9/06; H04R 9/10; H04R 2400/01; H04R 2400/03

USPC ..... 381/58, 59, 96, 111, 116, 117, 162, 381/163, 396, 400, 401, 402, 411

See application file for complete search history.

(56) References Cited

U.S. PATENT DOCUMENTS

| | | | | |
|---|---|---|---|---|
| 6,208,237 | B1 | 3/2001 | Saiki et al. | |
| 7,003,130 | B2 * | 2/2006 | Chung | 381/396 |
| 7,050,594 | B2 * | 5/2006 | Nakada et al. | 381/96 |
| 7,290,993 | B2 | 11/2007 | Vogeley et al. | |
| 7,912,509 | B2 * | 3/2011 | Lee | 455/567 |
| 8,547,048 | B2 * | 10/2013 | Murata | 318/686 |
| 8,829,843 | B2 * | 9/2014 | Murata | 318/686 |

FOREIGN PATENT DOCUMENTS

| | | |
|---|---|---|
| JP | H08-331694 A | 12/1996 |
| JP | 10-049148 A | 2/1998 |
| JP | 10-215499 | 8/1998 |

(Continued)

OTHER PUBLICATIONS

EPO English translation of JP11-55360.

(Continued)

*Primary Examiner* — Xu Mei

(57) ABSTRACT

A drive signal generating unit generates a drive signal having a cyclic waveform containing a zero period in a vibration mode. A driver unit generates the drive current in response to the drive signal generated by the drive signal generating unit so as to supply the drive current to a voice coil. An induced voltage detector detects the induced voltage occurring in the voice coil during a nonconducting period. A zero-cross detector detects the zero cross of the induced voltage detected by the induced voltage detector. The drive signal generating unit estimates the eigen-frequency of a vibration speaker from a detected position of the zero cross and brings the frequency of the drive signal close to the estimated eigen-frequency.

20 Claims, 7 Drawing Sheets

(56) References Cited

FOREIGN PATENT DOCUMENTS

| | | |
|---|---|---|
| JP | 11-55360 | 2/1999 |
| JP | 2004-343884 | 12/2004 |
| JP | 2005-337980 A | 12/2005 |
| JP | 2007-533902 | 11/2007 |
| JP | 2009-115505 | 5/2009 |

OTHER PUBLICATIONS

EPO English translation of JP2009-115505.

* cited by examiner

FIG.5

| COUNT VALUE | DRIVE FREQUENCY [Hz] | DRIVE WAVEFORM |
|---|---|---|
| 299 OR ABOVE | 147.0 | A |
| 298, 297 | 148.0 | B |
| 296, 295 | 149.0 | A |
| 294, 293 | 150.0 | B |
| 292, 291 | 151.0 | A |
| 290, 289 | 152.1 | B |
| 288, 287 | 153.1 | A |
| 286, 285 | 154.2 | B |
| 284, 283 | 155.3 | A |
| 282, 281 | 156.4 | B |
| 280, 279 | 157.5 | A |
| 278, 277 | 158.6 | B |
| 276, 275 | 159.8 | A |
| 274, 273 | 160.9 | B |
| 272, 271 | 162.1 | A |
| 270, 269 | 163.3 | B |
| 268, 267 | 164.6 | A |
| 266, 265 | 165.8 | B |
| 264, 263 | 167.0 | A |
| 262, 261 | 168.3 | B |
| 260, 259 | 169.6 | A |
| 258, 257 | 170.9 | B |
| 256, 255 | 172.3 | A |
| 254, 253 | 173.6 | B |
| 252, 251 | 175.0 | A |
| 250, 249 | 176.4 | B |
| 248, 247 | 177.8 | A |
| 246, 245 | 179.3 | B |
| 244, 243 | 180.7 | A |
| 242, 241 | 182.2 | B |
| 240, 239 | 183.8 | A |
| 238 OR BELOW | 185.3 | B |

DRIVE CONTROL CIRCUIT FOR VIBRATION SPEAKER

This application is based upon and claims the benefit of priority from the prior Japanese Patent Application No. 2010-203111, filed on Sep. 10, 2010, the entire content of which is incorporated herein by reference.

BACKGROUND OF THE INVENTION

1. Field of the Invention

The present invention relates to a drive control circuit of a vibration speaker having both a vibration function and a speaker function.

2. Description of the Related Art

A vibration speaker equipped with a vibration function and a speaker function is in practice use today. Since the vibration speaker is equipped with the both functions, it is expected that mobile devices (e.g., mobile phones, smartphones, portable game devices) into which the vibration speakers are incorporated be smaller in size and light in weight.

The vibration speaker, which is basically of the same configuration as a dynamic speaker, is provided with a voice coil, a magnetic circuit, and diaphragm. The force produced by the electricity flowing through the voice coil and the magnetism by the magnetic circuit is exerted on the magnetic circuit and the vibration plate. Though the magnetic circuit weighs a certain weight, the diaphragm is designed to be lightweight. Where a low-frequency signal is inputted to the voice coil, the magnetic circuit vibrates efficiently and the vibration function can be achieved fully. Where a high-frequency signal is inputted thereto, the magnetic circuit barely vibrates due to the weight itself. However, the diaphragm vibrates efficiently and therefore the speaker function can be achieved fully.

In a vibration mode where the vibration function of the vibration speaker is achieved, the vibration speaker is preferably driven at a frequency as close to its eigen frequency as possible (hereinafter, this eigen frequency will be referred to as "resonance frequency" also). The vibration speaker generates the most powerful vibration when the resonance frequency thereof agrees with the drive frequency.

Since the eigen frequency of the vibration speaker in the vibration mode is determined mainly by the magnetic circuit, the eigen frequency varies from one product to another. When the magnetic circuit is suspended by a frame through the spring, the eigen-frequency also varies according to the spring const.

Thus, in the conventional method where a fixed drive frequency is set to all drive control circuits for the vibration speakers, there are drive control circuits with a significant disagreement between the eigen frequency of the vibration speaker and the drive frequency thereof, thereby causing a drop in the yield. Also, even though the eigen frequency of the vibration speaker and the drive frequency thereof agree at first, there are cases where they deviate from each other with time and the vibration gets weaker.

SUMMARY OF THE INVENTION

A drive control circuit of a vibration speaker according to one embodiment of the present invention includes a voice coil; a magnetic circuit that produces reciprocating motion within a certain prescribed range; and a vibration plate that vibrates by force generated by electricity flowing through the voice coil and magnetic field of the magnetic circuit, the vibration speaker having a speaker mode for generating sound by vibrating the vibration plate and a vibration mode for transmitting vibration of the magnetic circuit to another vibration member, and the drive control circuit includes: a drive signal generating unit configured to generate a drive signal, for use with the speaker mode, in response to an audio signal set externally in the speaker mode and configured to generate a drive signal, for use with the vibration mode, having a cyclic waveform containing a zero period in the vibration mode; a driver unit configured to generate drive current in response to the drive signal generated by the drive signal generating unit so as to supply the drive current to the voice coil; an induced voltage detector configured to detect an induced voltage occurring in the voice coil during a nonconducting period in the vibration mode; and a zero-cross detector configured to detect zero cross of the induced voltage detected by the induced voltage detector. The drive signal generating unit estimates an eigen-frequency of the vibration speaker from a detected position of the zero cross in the vibration mode and brings the frequency of the drive signal for use with the vibration mode close to the estimated eigen-frequency.

Optional combinations of the aforementioned constituting elements, and implementations of the invention in the form of methods, apparatuses, systems and so forth may also be effective as additional modes of the present invention.

BRIEF DESCRIPTION OF THE DRAWINGS

Embodiments will now be described by way of examples only, with reference to the accompanying drawings which are meant to be exemplary, not limiting, and wherein like elements are numbered alike in several Figures in which:

FIG. 5 shows an example of a drive frequency table;

DETAILED DESCRIPTION OF THE INVENTION

The invention will now be described by reference to the preferred embodiments. This does not intend to limit the scope of the present invention, but to exemplify the invention.

Figure 1:
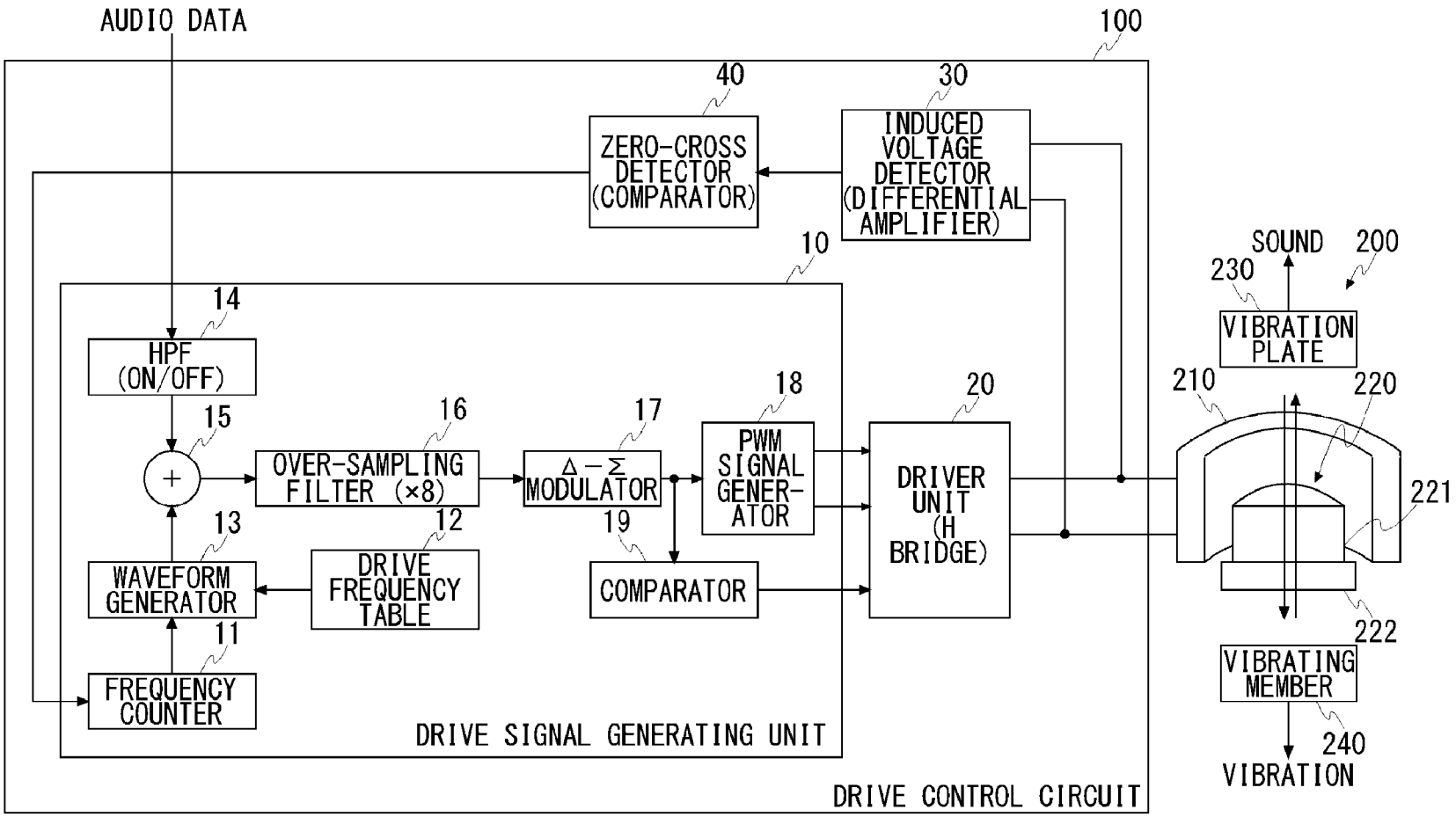
FIG. 1 shows a configuration of a drive control circuit of a vibration speaker according to an embodiment of the present invention.

FIG. 1 shows a configuration of a drive control circuit 100 of a vibration speaker 200 according to an embodiment of the present invention. The vibration speaker 200 includes a voice coil 210, a magnetic circuit 220 that produces reciprocating motion within a certain prescribed range, and a vibration plate 230 (e.g., diaphragm) that vibrates by the force generated by the electricity flowing through the voice coil 210 and the magnetic field of the magnetic circuit 220.

The magnetic circuit 220 is configured such that a permanent magnet 221 is fixed on a base 222. The permanent magnet 221 is fixed on the base 222 so that the magnetic field is produced in the horizontal direction from the permanent magnet 221. Though not shown in FIG. 1, the magnetic circuit 220 may be configured such that the magnetic circuit 220 is fixed to a frame through springs or such that the magnetic circuit 220 is housed within a frame whose movable range is prescribed.

Force is produced in the direction conforming to the Fleming's left-hand rule according to the direction of current flowing through the voice coil 210 and the direction of magnetic field generated by the permanent magnet 221. In FIG. 1, delivering the current to the voice coil 210 enables the generation of force in a direction vertical to the magnetic circuit 220. Then, changing the direction of current enables the generation of force in an upward or downward direction of the magnetic circuit 220. The vibration plate 230, which vibrates according to this force, radiates sound into air. The configuration described so far is similar to that of generally-used dynamic speaker.

The vibration speaker 200 has a speaker mode in which sound is generated by vibrating the vibration plate 230 and, additionally, a vibration mode in which the vibration of the vibration plate 230 is suppressed and the vibration of the magnetic circuit 220 is transmitted to another vibrating member 240.

The vibration speaker 200 is configured such that the magnetic circuit 220 is not fixed to the frame and therefore the magnetic circuit 220 itself is vibrated by the force produced according to the Fleming's left-hand rule. When a low-frequency current is inputted to the voice coil 210 in this configuration, the magnetic circuit 220 can follow the force. Thus, the magnetic circuit 220 itself vibrates and the vibration caused by the magnetic circuit 220 is transmitted to the vibrating member 240.

On the other hand, when a high-frequency current is inputted to the voice coil 210, the magnetic circuit 220 cannot follow the force. Thus the magnetic circuit 220 itself cannot vibrate. It is to be noted here that a frequency at which the magnetic circuit 220 no longer vibrates can be adjusted by adjusting the weight (mass) of the magnetic circuit 220.

The drive control circuit 100 includes a drive signal generating unit 10, a driver unit 20, an induced voltage detector 30, and a zero-cross detector 40. The drive signal generating unit 10 generates a drive signal, for use with the speaker mode, in response to an audio signal set externally in the speaker mode and generates a drive signal, for use with the vibration mode, having a cyclic waveform containing a zero period in the vibration mode. Here, the cyclic waveform containing a zero period in the vibration mode may be a positive/negative symmetric waveform. The zero period is a nonconducting period during which no power is supplied to the voice coil 210. A detailed description of the drive signal generating unit 10 will be given later.

The driver unit 20 generates a drive current in response to the drive signal generated by the drive signal generating unit 10 and supplies the drive current to the voice coil 210. The driver unit 20 cab be configured by a generally-known H-bridge circuit. Note that an LC filter (not shown) comprised of an inductor and a capacitor is inserted between the driver unit 20 and the vibration speaker 200.

The induced voltage detector 30 detects an induced voltage occurring in the voice coil 200 during a nonconducting period in the vibration mode. The zero-cross detector 40 detects zero crosses of the induced voltage detected by the induced voltage detector 30.

Figure 2:
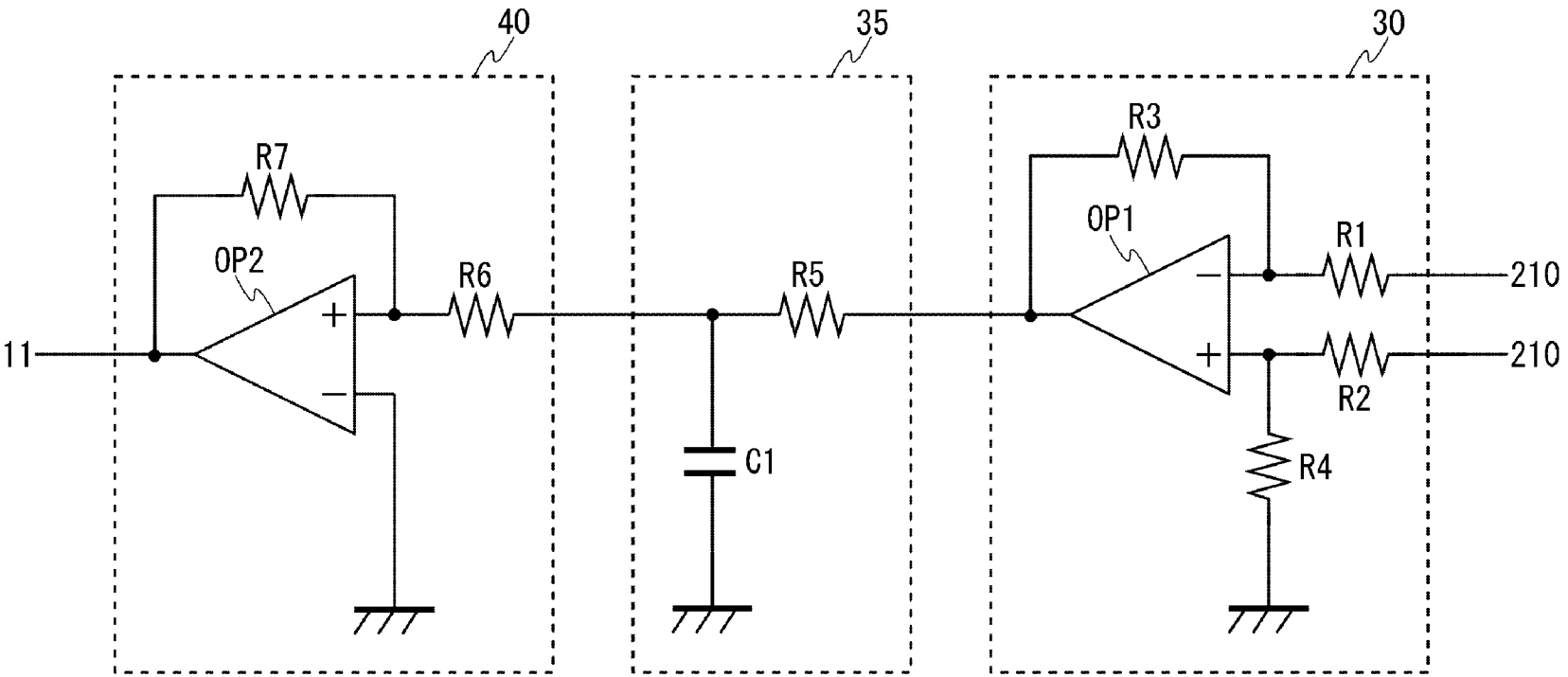
FIG. 2 shows exemplary configurations of a driver unit and an induced voltage detector.

FIG. 2 shows exemplary configurations of the driver unit 20 and the induced voltage detector 30. FIG. 2 shows an example where the induced voltage detector 30 is configured by a differential amplifier and the zero-cross detector 40 is configured by a comparator. A low-pass filter 35 (not shown in FIG. 1) is inserted between the differential amplifier and the comparator.

The differential amplifier includes a first operational amplifier (op-amp) OP1, a first resistor R1, a second resistor R2, a third resistor R3, and a fourth resistor R4. An inverting input terminal of the first op-amp OP1 is connected to a positive electrode terminal of the voice coil 210 via the first resistor R1, whereas a noninverting input terminal of the op-amp OP1 is connected to a negative electrode terminal of the voice coil 210 via the second resistor R2. An output terminal of the first op-amp OP1 and a node between the inverting input terminal thereof and the first resistor R1 are connected to each other via the third resistor R3. A node, between the noninverting input terminal of the first op-amp OP1 and the second resistor R2, and ground are connected to each other via the fourth resistor R4.

The differential amplifier amplifies a difference between a voltage applied to the noninverting input terminal of the first op-amp OP1 and a voltage applied to the inverting input terminal thereof, at a predetermined gain. The value of the first resistor R1 and the value of the third resistor R3 are set to the same resistance value, whereas the value of the second resistor R2 and the value of the fourth resistor R4 are set to the same resistance value. Under this condition, the gain of the differential amplifier is R3/R1.

The low-pass filter 35 includes a fifth resistor R5 and a capacitor C1. An input terminal of the fifth resistor R5 is connected to the output terminal of the first op-amp OP1. An output terminal of the fifth resistor R5 and ground are connected via the capacitor C1. The low-pass filter 35 smoothes an output signal of the above-described differential amplifier using the capacitance C1 so as to remove high-frequency noise.

The aforementioned comparator includes a second op-amp OP2, a sixth resistor R6, and a seventh resistor R7. A noninverting input terminal of the second op-amp OP2 is connected to the output terminal of the above-described differential amplifier via the low-pass filer 35 and the sixth resistor R6. An inverting input terminal of the second op-amp OP2 is grounded. An output terminal of the second op-amp OP2 and a node between the noninverting input terminal thereof and the sixth resistor R6 are connected to each other via the seventh resistor R7. This comparator constitutes a hysteresis comparator.

As the voltage inputted to the noninverting input terminal of the second op-amp OP2 exceeds zero, the second op-amp OP2 outputs a high level to the drive signal generating unit 10 (more precisely, a frequency counter 11 described later); if the voltage inputted thereto does not exceed zero, the second op-amp OP2 outputs a low level. Note here that this hysteresis comparator can set a dead band according to the ratio of the sixth resistor and the seventh resistor R7.

Now refer back to FIG. 1. The drive signal generating unit 10 estimates an eigen frequency of the vibration speaker 200 from a detected position of the zero cross in the vibration mode, and brings the frequency of the drive signal for use with the vibration mode close to the estimated eigen frequency. More specifically, the drive signal generating unit 10 counts a duration lasting from the beginning of one cycle of the drive signal for use with the vibration mode up to the end thereof, and determines the frequency of the drive signal for the next cycle, based on the counted value. More specifically, a value obtained when a sampling frequency (generally 44.1 kHz) is divided by the counted value is determined to be the drive frequency for the next cycle. In other words, the drive signal generating unit 10 adaptively varies the frequency of the aforementioned drive signal so that the drive signal for the next cycle corresponds to the counted value.

A description is given hereunder of a concrete structure of the drive signal generating unit 10 to achieve this adaptive control. The drive signal generating unit 10 includes a frequency counter 11, a drive frequency table 12, a waveform generator 13, high-pass filter 14, an adder 15, an over-sampling filter 16, a Δ–Σ.modulator.17, a pulse-width modulation (PWM) signal generator 18, and a comparator 19. A description is now given of an example where the drive signal generating unit 10 is configured by a logic circuit based on a class-D amplifier. Although it is assumed herein that the data handled within the drive signal generating unit 10 is digital data, the data is depicted as analog data in the Figures, as appropriate, for clarity of explanation.

Audio data is inputted to the high-pass filter 14 from the exterior. For example, audio data in the form of pulse code modulation (PCM) is inputted to the high-pass filter 14. The high-pass filter 14 passes high-frequency signals and blocks low-frequency signals based on a cutoff frequency. An output signal of the high-pass filter 14 is inputted to the adder 15.

In the present embodiment, when the high-pass filter 14 is controlled to be on, the speaker mode is selected and the vibration speaker 200 does not vibrate. On the other hand, when the high-pass filter 14 is controlled to be off, a multi-mode is selected where both audio output and vibration output are performed. In the latter case, low-frequency signals pass the high-pass filter 14 and therefore the low-frequency signals cause the magnetic circuit 220 to vibrate as well. Since, as will be described later, it is difficult to set a high impedance period in the driver unit 20 in the multi-mode, adaptive control cannot be performed on the resonance frequency of the vibration speaker 200. In this case, the driver unit 20 is driven in the vibration mode prior to a multi-mode operation, and the drive frequency obtained then is retained in a register. Hence, the driver unit 20 can be driven, even in the multi-mode, at a frequency as close to the resonance frequency as possible.

The adder 15 adds up data inputted from the high-pass filter 14 and data inputted from the waveform generator 13. Since the adaptive control of the resonance frequency of the vibration speaker 200 is not performed at the speaker mode in the present embodiment, the adder 15 does not actually add up the both data. Thus, the adder 15 of FIG. 1 functions as a selector.

The oversampling filter 16 oversamples the inputted data by a predetermined factor (i.e., by a factor of 8). Output data of the oversampling filter 16 is inputted to the Δ–Σ.modulator 17. The Δ–Σ.modulator 17 Δ–Σ.modulates the data inputted from the oversampling filter 16 and performs noise shaping of the modulated data. Output data of the Δ–Σ.modulator 17 is outputted to the PWM signal generator 18 and the comparator 19, respectively.

The PWM generator 18 generates a PWM signal having a duty ratio corresponding to the data inputted from the Δ–Σ.modulator 17. The PWM signal is inputted to the driver unit 20 where the amount and direction of current to be delivered to the voice coil 210 are determined. If, for example, the driver unit 20 is configured by an H-bridge circuit, the PWM signal will be inputted to gate terminals of four transistor that constitute the H-bridge circuit so as to control the on/off time of these transistors.

Figure 3:
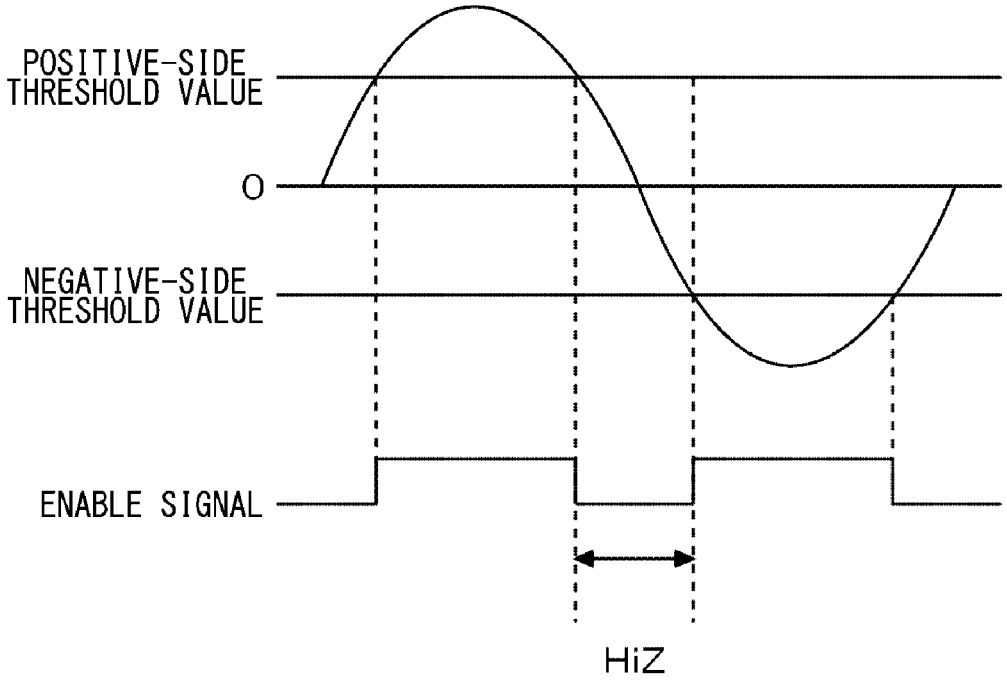
FIG. 3 shows a method of generating an enable signal.

The comparator 19 generates an enable signal to be supplied to the driver unit 20, based on the data inputted from the Δ–Σ modulator 17. FIG. 3 shows a method of generating an enable signal. Though the data inputted to the comparator 19 is digital data as described above, the data inputted thereto is depicted in the form of analog data (as an example of sine wave) in FIG. 3. A positive-side threshold value is set to a value that has increased to the positive side by a predetermined value from zero. Similarly, a negative-side threshold value is set to a value that has increased to the negative side by a predetermined value from zero. The positive-side threshold value and the negative-side threshold value can be set based on statistical data obtained through experiments or simulation runs done by a designer.

If the data inputted from the Δ–Σ.modulator 17 lies within a range between the negative-side threshold value and the positive-side threshold value, the comparator 19 will output a low level. Otherwise, the comparator 19 outputs a high level. The enable signal thus generated controls the driver unit 20 to a high impedance state during a low level period. In other words, if the drive signal inputted to the drive unit 20 is near zero, control will be performed so that the operation of the driver unit 20 be stopped. While the operation of the driver unit 20 is stopped, only the induced voltage occurring in the voice coil 210 can be detected by the induced voltage detector 30.

The frequency counter 11 counts a period between rising edges or a period between falling edges of a signal inputted from the zero-cross detector 40. Where the circuit configuration of FIG. 2 is implemented, the frequency counter 11 counts the period between rising edges. A rising edge is an edge generated with timing with which an induced voltage occurring in the voice coil 210 crosses zero from a negative voltage to a positive voltage. A falling edge is an edge generated with timing with which the induced voltage crosses zero from a positive voltage to a negative voltage. The comparator as shown in FIG. 2 inverts its output with zero-crossing timing of the induced voltage.

The timing with which the induced voltage crosses zero corresponds to a state where the magnetic circuit 220 stops. The state where the magnetic circuit 220 stops is a state where the reciprocating motion of the magnetic circuit 220 is at its peak. Thus, a period starting from a given rising (falling) edge till the next rising (falling) edge is equivalent to one cycle of vibration of the magnetic circuit 220.

The frequency counter 11 outputs the counted value of between rising edges or falling edges, to the waveform generator 13. The waveform generator 13 produces data where a sine wave (sinusoidal wave) is processed for the purpose of measuring the resonance frequency in the vibration mode. For example, a drive signal having a waveform defined such that a sine wave is multiplied by a predetermined window function (e.g., Blackman window) is generated as a drive signal for use with the vibration mode.

At this time, the waveform generator 13 changes the frequency of the drive signal for use with the vibration mode by expanding the zero period. More specifically, the waveform generator 13 interpolates or deletes zero data to or from the zero-cross level so that the frequency of the drive signal becomes the determined frequency. Note that the number of interpolations of zero data is 4n (n being a natural number). Prior to the changing of the frequency thereof, the waveform generator 13 selects drive waveform data, for which zero data is readily interpolated or deleted, from among a plurality of drive wave data whose sampling points differ. Since assumed in the present embodiment is a configuration where the sampling can be done every 2 Hz, either one of two kinds of drive waveform data is selected. This concrete example will be discussed later. Note that the frequency unit where the sampling can be done is coarser, an increased number of drive waveform data may be prepared and then the optimum drive waveform data may be selected.

Figure 4:
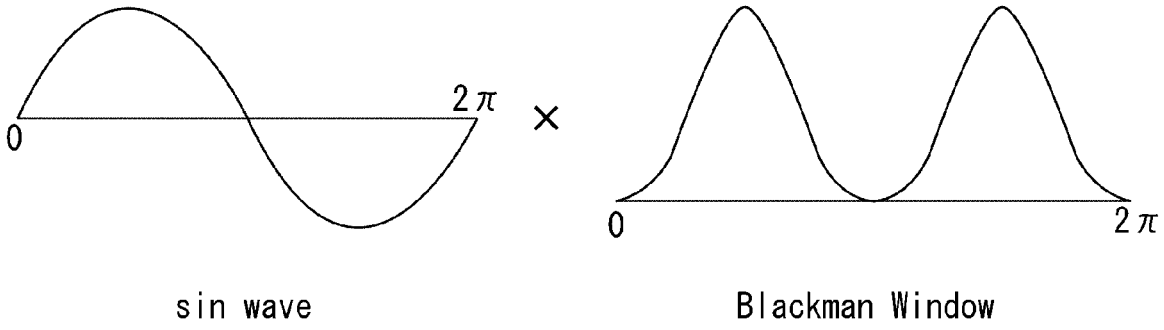
FIG. 4 shows a sine wave and a Blackman window.

FIG. 4 shows a sine wave and a Blackman window. If this sine wave is multiplied by the Blackman window, a waveform like the drive signal discussed in conjunction with FIG. 7 can be generated. The waveform generator 13 may obtain the frequency after the change, by calculation whenever the frequency of the drive signal for use with vibration mode is changed. However, in the present embodiment, a description is given of an example where the drive frequency table 12 is used.

FIG. 5 shows an example of the drive frequency table 12. The drive frequency table 12 shows an example where the sampling frequency used is 44.1 kHz. The drive frequency table 12 is a table describing the drive frequency and the drive waveform data for each counted value. In the example shown in FIG. 5, the drive frequency is evaluated such that 44.1 kHz is divided by the counted value. If the sampling frequency differs, another table associated with a different sampling frequency must be prepared.

Figure 6:
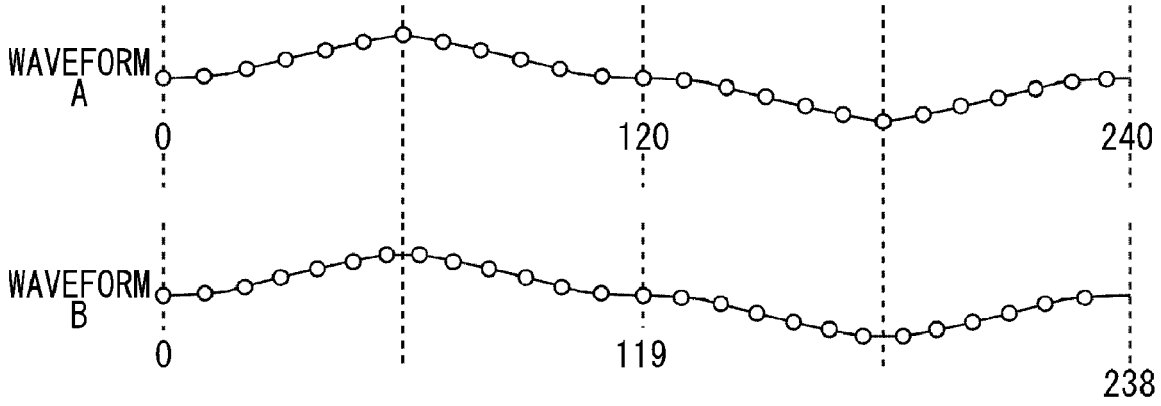
FIG. 6 is a diagram used to explain drive waveform data.

FIG. 6 is a diagram used to explain the drive waveform data. FIG. 6 illustrates an example where two kinds of drive waveform data, namely waveform A and waveform B, are prepared. Each drive waveform data is generated such that the drive waveform data is symmetrical about a top peak or bottom peak thereof. Waveform A is suitable to the sampling of odd-numbered drive frequencies, whereas waveform B is suitable to the sampling of even-numbered drive frequencies.

Now, refer back to FIG. 5. For the sake of simplicity, when the counted value is 299 or above, the drive frequency for the next cycle is all set to 147 Hz in FIG. 5. Similarly, for the sake of simplicity, when the counted value is 238 or below, the drive frequency for the next cycle is all set to 185.3 Hz in FIG. 5. Also, the drive waveform data are set alternately to waveform A and waveform B.

The waveform generator 13 references the drive frequency table 12, selects a drive frequency and a drive waveform for the next cycle, and interpolates or removes the zero data to or from the zero-cross level, thereby generating a drive signal for the next cycle. In this manner, the drive frequency is controlled by interpolating or removing the zero data. Thus, the circuit scale can be reduced as compared with the case where the table is prepared for every drive frequency.

Figure 7:
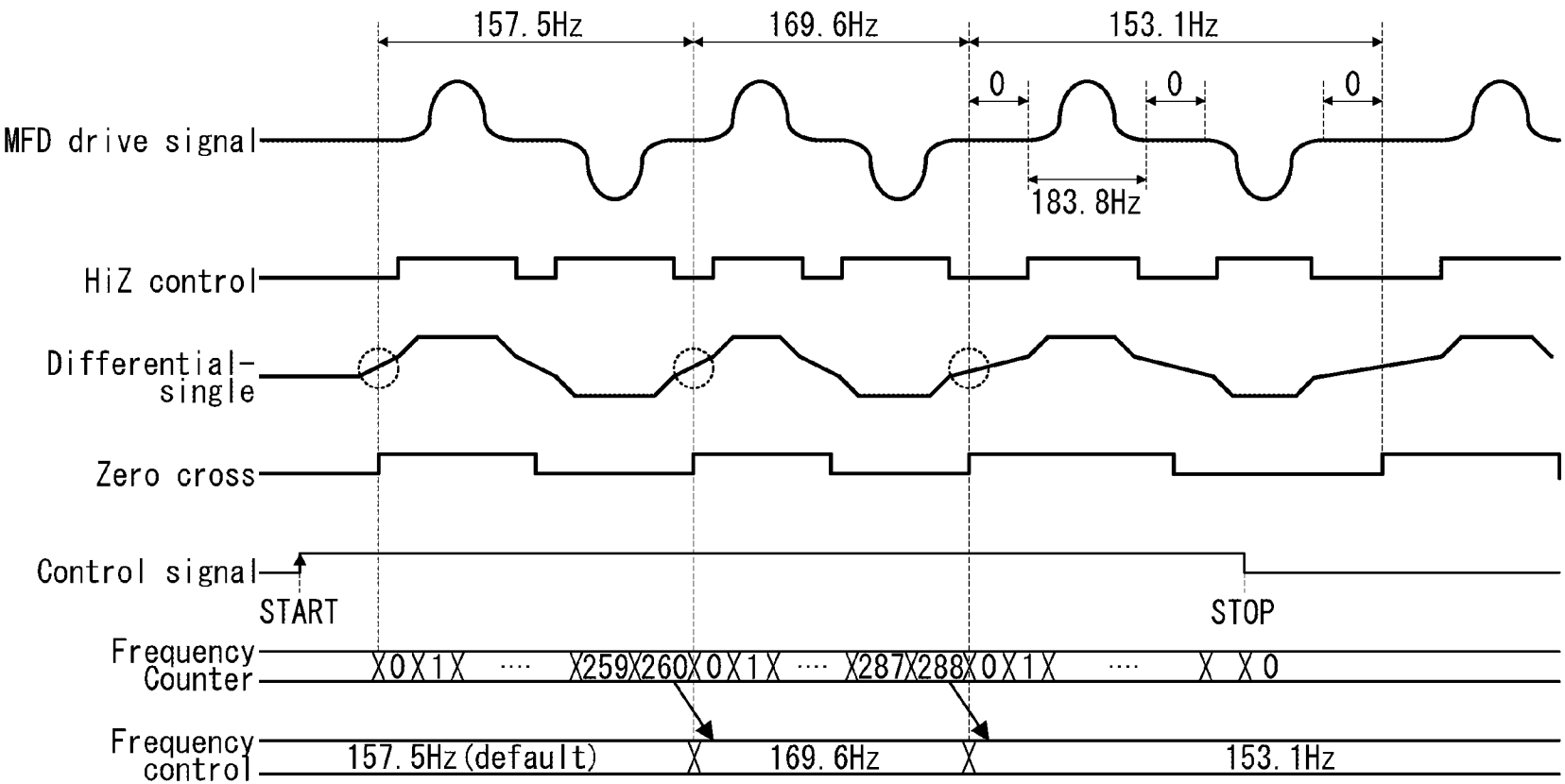
FIG. 7 is a timing chart showing an operation example of a drive control circuit according to an embodiment of the present invention.

FIG. 7 is a timing chart showing an operation example of the drive control circuit 100 according to an embodiment of the present invention. In FIG. 7, "MFD drive signal" indicates a drive signal set from the PWM signal generator 18 to the driver unit 20. "HiZ control" indicates an enable signal which is generated by the comparator 19 and set to the driver unit 20. "Differential signal" is an output signal of the induced voltage detector 30. "Zero cross" is an edge signal indicating the zero-cross timing outputted from the zero-cross detector 40. "Control signal" is a control signal used to specify whether an adaptive control of the frequency of the drive signal in the vibration mode of the present embodiment is to be enabled or not. "Frequency counter" is a counted value in between rising edges of "Zero cross" in the frequency counter 11. "Frequency Control" is a frequency of the drive signal.

In the example of FIG. 7, the frequency of the drive signal is set to 157.5 Hz as the default value. As "Control signal" rises to a high level, the induced voltage detector 30, the zero-cross detector 40, the frequency counter 11, the drive frequency table 12, and the waveform generator 13 are enabled, which in turn starts the adaptive control of the frequency. The first "Frequency counter" after the adaptive control has started is 260. Referencing FIG. 5 tells us that the drive frequency corresponding to "260" is 169.6 Hz. Thus, the "Frequency Control" for the next cycle is 169.6 Hz. Also, as a result of the change of the frequency, "MFD drive signal" is of a waveform such that a predetermined number of zero data lying in the zero-cross level is deleted.

The next "Frequency counter" is 288. Referencing FIG. 5 verifies that the drive frequency corresponding to "288" is 153.1 Hz. Thus, the "Frequency Control" for the next cycle is 153.1 Hz. Also, as a result of the change of the frequency, "MFD drive signal" is of a waveform such that a predetermined number of zero data lying in the zero-cross level is interpolated. Note that during this cycle, "Control signal" falls to a low level. As a result, the induced voltage detector 30, the zero-cross detector 40, the frequency counter 11, the drive frequency table 12, and the waveform generator 13 are disabled, which in turn terminates the adaptive control of the frequency.

As described above, by employing the drive control circuit 100 according to the present embodiment, the frequency of a drive signal for the next cycle is adjusted using the counted value corresponding to the measured frequency of the drive signal of vibration speaker 200. Hence, regardless of the state of the vibration speaker 200, the vibration speaker 200 can be continuously driven at a frequency as close to the resonance frequency thereof as possible. As a result, the variations in the eigen frequencies among the manufactured products of vibration speakers 200 can be absorbed and therefore the reduction in the yield in the case of the mass production of the vibration speakers 200 can be prevented.

Also, a waveform obtained when a sine wave is multiplied by a predetermined window function is used instead of the sine wave, so that the frequency control of the drive signal can be performed by interpolating or deleting the zero data. Hence, the amount of calculation and the circuit scale can be reduced. Also, noise outputted from the vibration speaker 200 can be reduced.

In contrast thereto, if the adaptive control of the drive signal according to the present embodiment is to be performed using the sine wave, the conducting during which power is supplied to the voice coil 210 of the vibration speaker 200 and the nonconducting period during which no power is supplied thereto need to be set. In this case, a distortion may be caused in the drive waveform, thereby causing a situation where large noise is outputted from the vibration speaker 200.

The present invention has been described based on illustrative embodiments. These embodiments are intended to be illustrative only and it will be obvious to those skilled in the art that various modifications to constituting elements and processes could be further developed and that such additional modifications are also within the scope of the present invention.

What is claimed is:

1. A drive control circuit of a vibration speaker including a voice coil, a magnetic circuit that produces reciprocating motion within a certain prescribed range, and a vibration plate that vibrates by force generated by electricity flowing through the voice coil and magnetic field of the magnetic circuit, the vibration speaker having a speaker mode for generating sound by vibrating the vibration plate and a vibration mode for transmitting vibration of the magnetic circuit to another vibration member, the drive control circuit comprising:

a drive signal generating unit configured to generate a drive signal, for use with the speaker mode, in response to an audio signal set externally in the speaker mode and configured to generate a drive signal, for use with the vibration mode, having a cyclic waveform containing a zero period in the vibration mode;

a driver unit configured to generate drive current in response to the drive signal generated by said drive signal generating unit so as to supply the drive current to the voice coil;

an induced voltage detector configured to detect an induced voltage occurring in the voice coil during a nonconducting period in the vibration mode; and a zero-cross detector configured to detect zero cross of the induced voltage detected by said induced voltage detector, wherein said drive signal generating unit estimates an eigen-frequency of the vibration speaker from a detected position of the zero cross in the vibration mode and brings the frequency of the drive signal for use with the vibration mode close to the estimated eigen-frequency.

2. A drive control circuit of a vibration speaker according to claim 1, wherein said drive signal generating unit counts a duration lasting from a beginning of one cycle of the drive signal for use with the vibration mode up to an end thereof, and determines a frequency of the drive signal for the next cycle, based on the counted value.

3. A drive control circuit of a vibration speaker according to claim 1, wherein the drive signal for use with the vibration mode is defined such that a sinusoidal wave is multiplied by a predetermined window function, and wherein said drive signal generating unit changes the frequency of the drive signal for use with the vibration mode by expanding the zero period.

4. A drive control circuit of a vibration speaker according to claim 2, wherein the drive signal for use with the vibration mode is defined such that a sinusoidal wave is multiplied by a predetermined window function, and wherein said drive signal generating unit changes the frequency of the drive signal for use with the vibration mode by expanding the zero period.

5. A drive control circuit of a vibration speaker according to claim 3, wherein prior to the changing of the frequency of the drive signal for use with the vibration mode, said drive signal generating unit selects drive waveform data, for which zero data is readily interpolated or deleted, from among a plurality of drive wave data whose sampling points differ.

6. A drive control circuit of a vibration speaker according to claim 4, wherein prior to the changing of the frequency of the drive signal for use with the vibration mode, said drive signal generating unit selects drive waveform data, for which zero data is readily interpolated or deleted, from among a plurality of drive wave data whose sampling points differ from each other.

7. A drive control circuit of a vibration speaker according to claim 6, wherein said drive signal generating unit generates a drive for the next cycle by referencing a table, the table describing drive frequency and drive waveform data for each counted value.

8. A drive control circuit suitable for use with a vibration speaker having a speaker mode and a vibration mode, comprising:

a drive signal generating unit configured to generate a drive signal, for use with the speaker mode, in response to an audio signal set externally in the speaker mode and configured to generate a drive signal, for use with the vibration mode, having a cyclic waveform containing a zero period in the vibration mode;

a driver unit configured to generate drive current in response to the drive signal generated by said drive signal generating unit so as to supply the drive current to the vibration speaker;

an induced voltage detector configured to detect an induced voltage occurring during a nonconducting period in the vibration mode; and a zero-cross detector configured to detect zero cross of the induced voltage detected by said induced voltage detector, wherein said drive signal generating unit estimates an eigen-frequency of the vibration speaker from a detected position of the zero cross in the vibration mode and brings a frequency of the drive signal for use with the vibration mode close to the estimated eigen-frequency.

9. The drive control circuit according to claim 8, wherein said drive signal generating unit counts a duration lasting from a beginning of one cycle of the drive signal for use with the vibration mode up to an end thereof, and determines the frequency of the drive signal for the next cycle, based on the counted value.

10. The drive control circuit according to claim 9, wherein the drive signal for use with the vibration mode is defined such that a sinusoidal wave is multiplied by a predetermined window function, and wherein said drive signal generating unit changes the frequency of the drive signal for use with the vibration mode by expanding the zero period.

11. The drive control circuit according to claim 10, wherein prior to the changing of the frequency of the drive signal for use with the vibration mode, said drive signal generating unit selects drive waveform data, for which zero data is readily interpolated or deleted, from among a plurality of drive wave data whose sampling points differ.

12. The drive control circuit according to claim 11, wherein said drive signal generating unit generates a drive for the next cycle by referencing a table, the table describing drive frequency and drive waveform data for each counted value.

13. The drive control circuit according to claim 8, wherein the drive signal for use with the vibration mode is defined such that a sinusoidal wave is multiplied by a predetermined window function, and wherein said drive signal generating unit changes a frequency of the drive signal for use with the vibration mode by expanding the zero period.

14. The drive control circuit according to claim 13, wherein prior to the changing of the frequency of the drive signal for use with the vibration mode, said drive signal generating unit selects drive waveform data, for which zero data is readily interpolated or deleted, from among a plurality of drive wave data whose sampling points differ from each other.

15. A method suitable for use with a vibration speaker having a speaker mode and a vibration mode, comprising:

generating a drive signal, for use with the speaker mode, in response to an audio signal set externally in the speaker mode;

generating a drive signal, for use with the vibration mode, having a cyclic waveform containing a zero period in the vibration mode;

generating a drive current in response to the drive signal generated by said drive signal generating unit so as to supply the drive current to the vibration speaker;

detecting an induced voltage occurring during a nonconducting period in the vibration mode; and detecting a zero cross of the induced voltage;

estimating an eigen-frequency of the vibration speaker from a detected position of the zero cross in the vibration mode; and bringing a frequency of the drive signal for use with the vibration mode close to the estimated eigen-frequency.

16. The method according to claim 15, further comprising:

counting a duration lasting from a beginning of one cycle of the drive signal for use with the vibration mode up to an end thereof; and determining the frequency of the drive signal for the next cycle, based on the counted duration.

17. The method according to claim 16, further comprising:

multiplying a sinusoidal wave by a predetermined window function to obtain the drive signal for use with the vibration mode; and changing the frequency of the drive signal for use with the vibration mode by expanding the zero period.

18. The method according to claim 17, further comprising:

selecting drive waveform data, for which zero data is readily interpolated or deleted, from among a plurality of drive wave data whose sampling points differ, prior to the changing of the frequency of the drive signal for use with the vibration mode.

19. The method according to claim 15, further comprising:

multiplying a sinusoidal wave by a predetermined window function to obtain the drive signal for use with the vibration mode; and changing the frequency of the drive signal for use with the vibration mode by expanding the zero period.

20. The method according to claim 19, further comprising:

selecting drive waveform data, for which zero data is readily interpolated or deleted, from among a plurality of drive wave data whose sampling points differ, prior to the changing of the frequency of the drive signal for use with the vibration mode.

* * * * *